US008011415B2

(12) United States Patent
Hirata et al.

(10) Patent No.: US 8,011,415 B2
(45) **Date of Patent: *Sep. 6, 2011**

(54) FLASKLESS MOLDING APPARATUS FOR AN UPPER AND A LOWER MOLD

(75) Inventors: Minoru Hirata, Toyokawa (JP); Takayuki Komiyama, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 79 days.

This patent is subject to a terminal disclaimer.

(21) Appl. No.: 11/921,735

(22) PCT Filed: May 30, 2006

(86) PCT No.: PCT/JP2006/310763

§ 371 (c)(1),
(2), (4) Date: Dec. 7, 2007

(87) PCT Pub. No.: WO2006/134770

PCT Pub. Date: Dec. 21, 2006

(65) Prior Publication Data

US 2009/0145573 A1 Jun. 11, 2009

(30) Foreign Application Priority Data

Jun. 13, 2005 (JP) ..... 2005-171962

(51) Int. Cl.
*B22C 15/00* (2006.01)

(52) U.S. Cl. ..... 164/172; 164/37

(58) Field of Classification Search ..... None
See application file for complete search history.

(56) References Cited

U.S. PATENT DOCUMENTS 3,589,432 A * 6/1971 Miller et al. ..... 164/182
4,313,486 A * 2/1982 Kondo et al. ..... 164/38
4,463,794 A 8/1984 Shioda
5,063,988 A * 11/1991 Follstaedt et al. ..... 164/463
5,246,058 A * 9/1993 Murata ..... 164/182

(Continued)

FOREIGN PATENT DOCUMENTS

DE 33 12 539 C1 3/1984

(Continued)

*Primary Examiner* — Jessica L Ward
*Assistant Examiner* — Steven Ha
(74) *Attorney, Agent, or Firm* — Finnegan, Henderson, Farabow, Garrett & Dunner, L.L.P.

(57) ABSTRACT

A flaskless molding apparatus for an upper and a lower mold that can produce molds comprised of molding sand with a substantially uniform density. The apparatus includes a match plate having patterns held between a cope flask and a drag flask, a squeezing mechanism having a plurality of upper and lower segmented-squeeze feet, wherein the upper and the lower segmented-squeeze feet are insertable into openings of each of the cope flask and the drag flask respectively, which openings are opposite to the match plate, and wherein the squeezing mechanism can support and rotate the cope flask and the drag flask so that the mechanism allows the cope flask and the drag flask to be rotated clockwise or counterclockwise in a perpendicular plane about a supporting shaft and so that the cope flask and the drag flask can be positioned perpendicular or horizontal, and a device for moving the segmented-squeeze feet, wherein the device can control positions of the upper and the lower segmented-squeeze feet, which positions determine the condition of the molding sand in the molding spaces, according to intervals between the match plate and each of the upper and the lower segmented-squeeze feet opposite to the match plate.

6 Claims, 10 Drawing Sheets

U.S. PATENT DOCUMENTS

| | | | | |
|---|---|---|---|---|
| 6,470,953 | B1 * | 10/2002 | Hirata et al. | 164/37 |
| 2004/0129404 | A1 | 7/2004 | Amano et al. | |

FOREIGN PATENT DOCUMENTS

| | | | |
|---|---|---|---|
| EP | 1 222 980 | A1 | 7/2002 |
| EP | 1 433 548 | A1 | 6/2004 |
| JP | 62-16736 | | 4/1981 |
| JP | 57-195557 | | 12/1982 |
| JP | 59-73148 | | 4/1984 |
| JP | 4084647 | | 3/1992 |
| JP | 2002-73159 | | 3/2002 |
| JP | 2003-103345 | | 4/2003 |
| JP | 2003-340551 | | 12/2003 |

* cited by examiner

FLASKLESS MOLDING APPARATUS FOR AN UPPER AND A LOWER MOLD

TECHNICAL FIELD

This invention relates to a flaskless molding apparatus for an upper and a lower mold. Particularly, it relates to a flaskless molding apparatus for an upper and a lower mold which apparatus can produce the flaskless upper and the lower mold that are stacked and have a uniform density of molding sand.

Conventionally, as one of the molding machines of this type, there is a type of apparatus that comprises the following:

a first station, which is disposed above a base, for compressing molding sand in a molding space by squeezing the sand in a horizontal direction, a second station, which is disposed near a lower surface of the base, for stacking an upper and a lower mold in a perpendicular direction against the lower surface of the base and for stripping flasks, wherein two pairs each of cope flasks and drag flasks are alternately and intermittently reciprocated between the first and the second station, and wherein a flaskless upper mold and a flaskless lower mold that are stacked are produced. (See Patent Document 1.)

Patent Document 1: Examined Japanese Patent Application Publication No. S62-16736

DISCLOSURES OF INVENTIONS

However, the conventional flaskless molding machine for molding an upper and a lower mold, which machine is constituted as explained in the above paragraph, has problems to be solved, such as the flaskless upper mold and the flaskless lower mold made by the machine do not have enough uniformity in density of the molding sand.

The present inventions have been conceived to solve the problems. Namely, the purpose of them is to provide a flaskless molding apparatus for an upper and a lower mold, which apparatus can produce a flaskless upper mold and a flaskless lower mold comprised of molding sand with a substantially uniform density.

The flaskless molding apparatus for an upper and a lower mold of this invention is comprised of:

(a) a cope flask and a drag flask, wherein each flask has openings at its both ends and has a sand-filling port at its side wall, (b) a conveying mechanism for inserting a match plate between the cope flask and the drag flask and for taking it out from therebetween, (c) a squeezing mechanism to squeeze molding sand, comprising an upper squeezing means having a plurality of upper segmented-squeeze feet and a lower squeezing means having a plurality of lower segmented-squeeze feet, wherein the plurality of upper and the lower segmented-squeeze feet are insertable into each opening of the cope flask and the drag flask respectively, which openings are positioned on the opposite side of the flask from the match plate, wherein the squeezing mechanism allows the match plate to be held between the cope flask and the drag flask, and wherein the squeezing mechanism can support and rotate the cope flask and the drag flask so that the mechanism allows the cope flask and the drag flask to be rotated clockwise or counterclockwise in a perpendicular plane about a supporting shaft and so that the cope flask and the drag flask holding the match plate therebetween can be perpendicularly or horizontally positioned, (d) a driving mechanism to rotate the squeezing mechanism clockwise or counterclockwise, and (e) an sand-supplying mechanism to fill the molding spaces defined by the match plate and the plurality of the upper and the lower segmented-squeeze feet opposite to the match plate with the molding sand, through the sand-filling ports of the cope flask and the drag flask perpendicularly positioned by the driving mechanism, the apparatus further comprising a means for moving the segmented-squeeze feet so that the positions of the upper and the lower segmented-squeeze feet (which positions determine the condition of the molding sand in the molding spaces when the spaces are filled with the molding sand), can be controlled according to the intervals between the match plate and each of the upper and the lower segmented-squeeze feet opposite to the match plate and so that after squeezing the molding sand, the molds have a substantially uniform density of the molding sand.

According to this invention, the flaskless upper mold and the flaskless lower mold which have enough uniform density of the molding sand can be produced.

Further, this invention allows the surface of each of the upper and the lower mold facing the upper and the lower segmented-squeeze feet respectively to be substantially flattened.

BRIEF DESCRIPTION OF THE DRAWINGS

FIG. 8 is constituted of a pair of a plane view of an upper portion of FIG. 8, and an elevational view of a lower portion of FIG. 8.

FIG. 9 is constituted of a pair of a plane view of an upper portion of FIG. 9, and an elevational view of a lower portion of FIG. 9.

FIG. 10 is constituted of a pair of a plane view of an upper portion of FIG. 10, and an elevational view of a lower portion of FIG. 10.

PREFERRED EMBODIMENTS OF THE INVENTION

Figure 1:
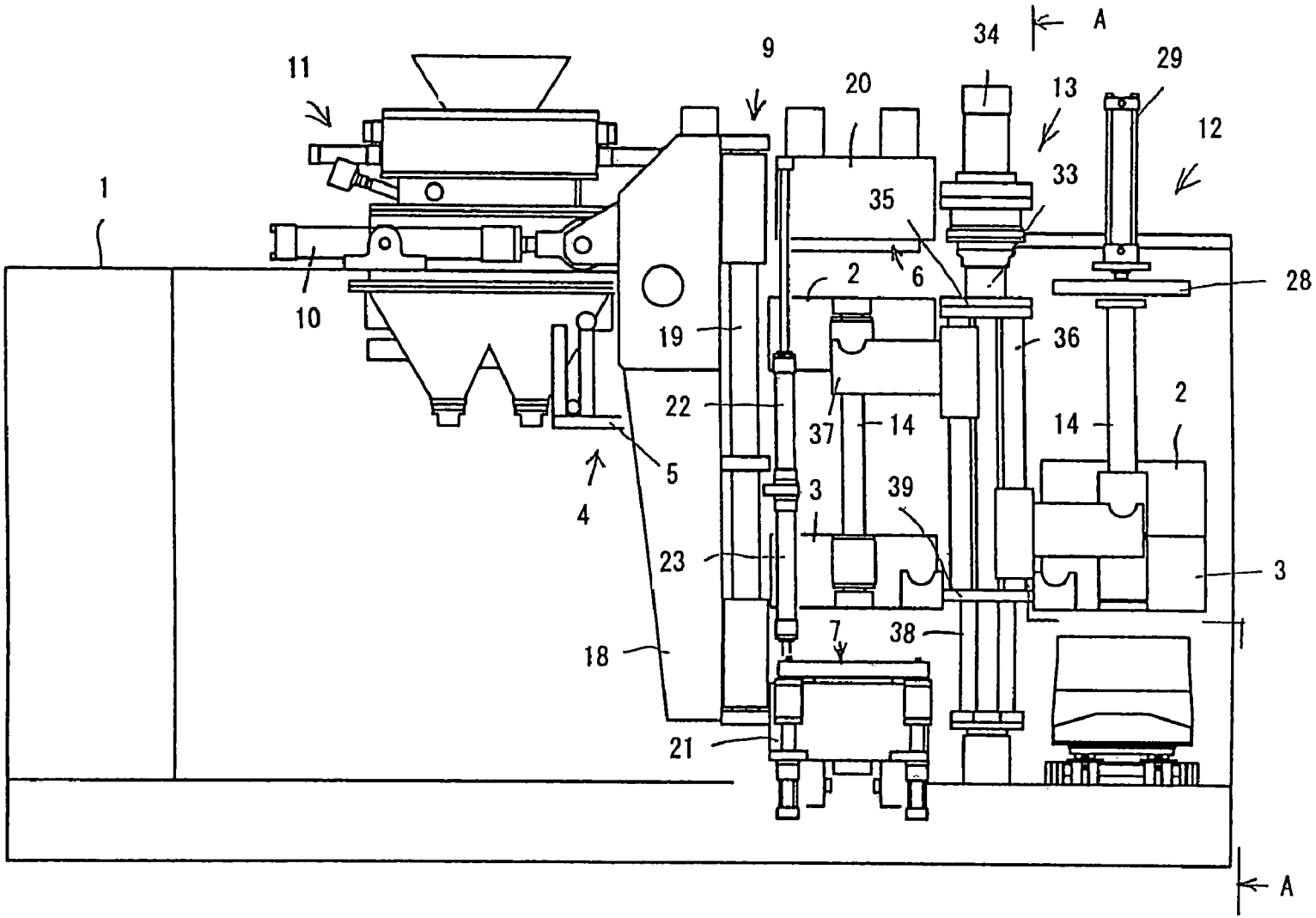
FIG.1 shows an elevational view of a flaskless molding apparatus for an upper and a lower mold of the preferred embodiment of the invention.

Preferred embodiments of this invention for a flaskless molding apparatus for an upper and a lower mold are now explained in detail based on FIGS. 1-5. As shown in FIGS.

1-4, the flaskless molding apparatus of this invention for the upper and the lower mold comprises:

a base 1 having an internal space and a rectangular parallelepiped shape, two pairs each of cope flasks 2 and drag flasks 3, a conveying mechanism 4 for inserting a match plate 5 between the cope flask 2 and the drag flask 3 and for taking it out from therebetween, a squeezing mechanism 9 to squeeze molding sand, a cylinder 10, disposed in the horizontal direction as a driving mechanism to rotate the squeezing mechanism 9 clockwise or counterclockwise, a sand-supplying mechanism 11 to fill molding spaces with the molding sand, and a stripping mechanism 12 to strip the upper and the lower mold.

Figure 3:
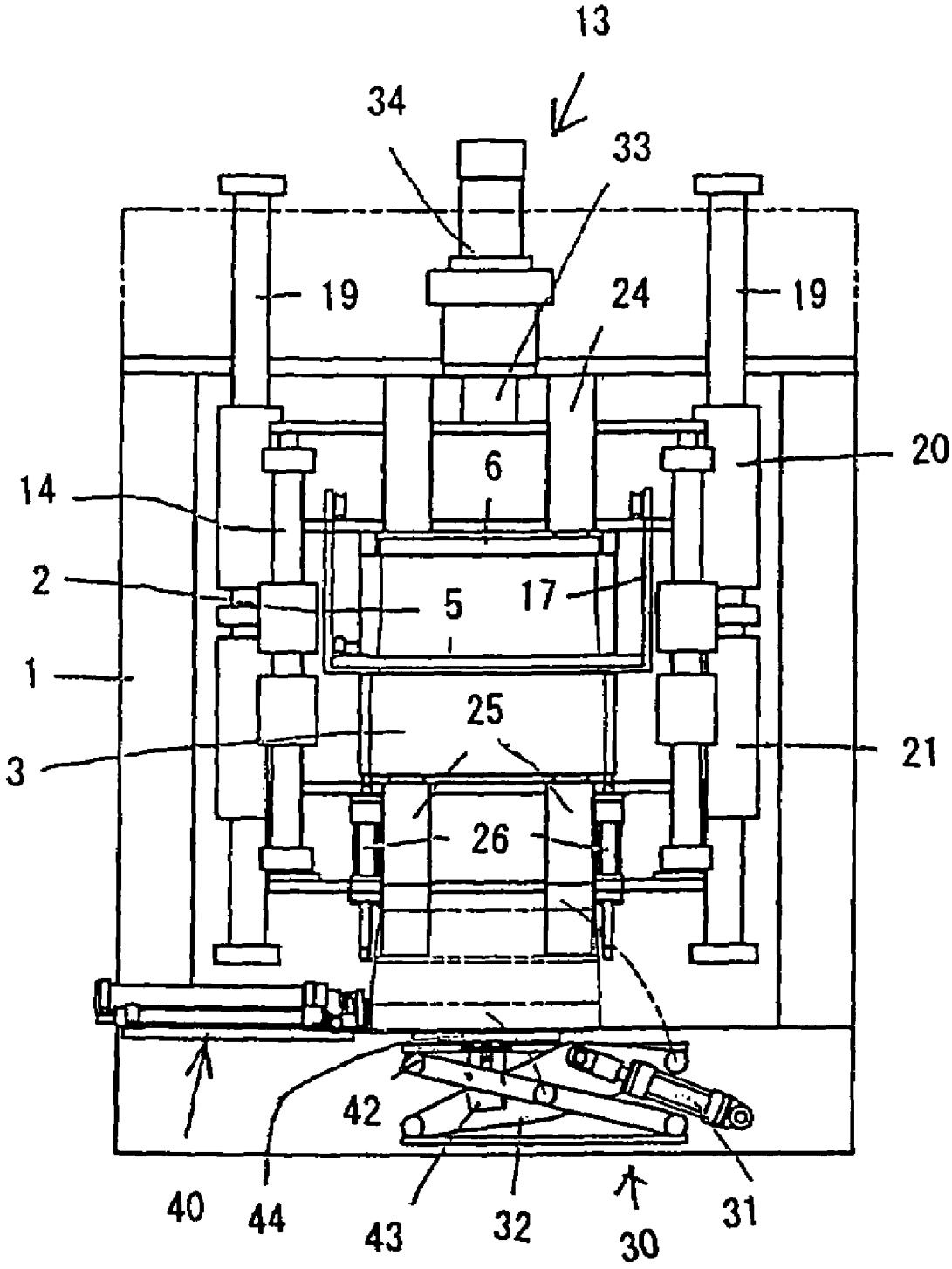
FIG. 3 shows a sectional view taken along the "A-A" line of FIG. 1.
Figure 4:
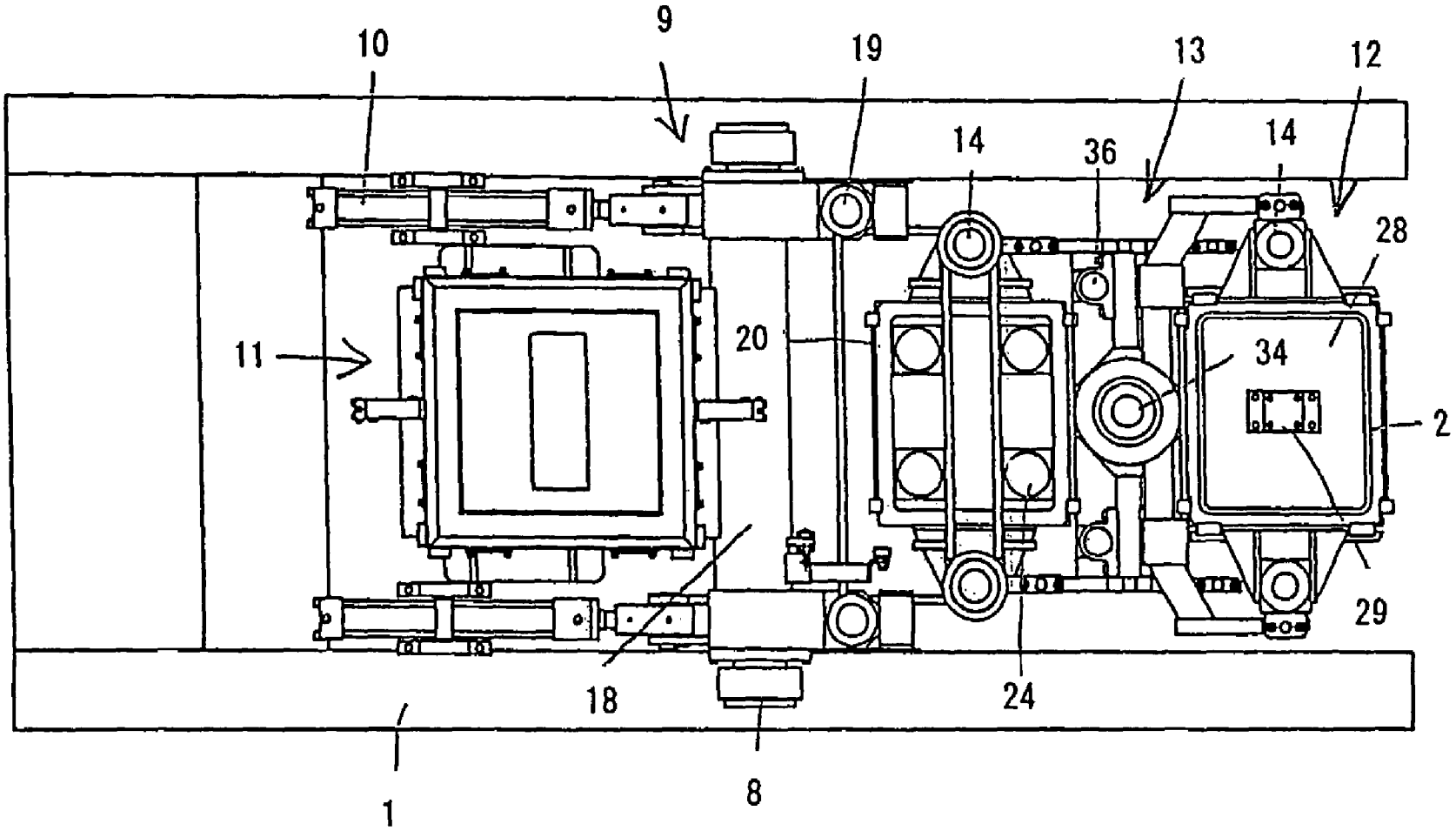
FIG. 4 shows a partially sectional plane view of FIG. 1.

For each pair of cope flasks 2 and drag flasks 3 of the two pairs of them, as shown in FIGS. 1 and 3, a pair of connecting rods 14 are provided and vertically extend near the front outer surfaces of the cope flask 2 and the rear outer surface of cope flask 2 (the right and the left side of the cope flask 2 shown in FIG. 3). The drag flask 3 is sliderably connected to the pair of connecting rods 14 and disposed therebetween. The drag flask 3 can be grappled by the lower ends of the pair of connecting rods 14. Protuberances (not shown, and which are used for holding the flasks by the connecting rods) are disposed at the centers of the front and rear outer surfaces of the cope flask 2 and are also disposed at those of the drag flask 3 respectively.

Figure 2:
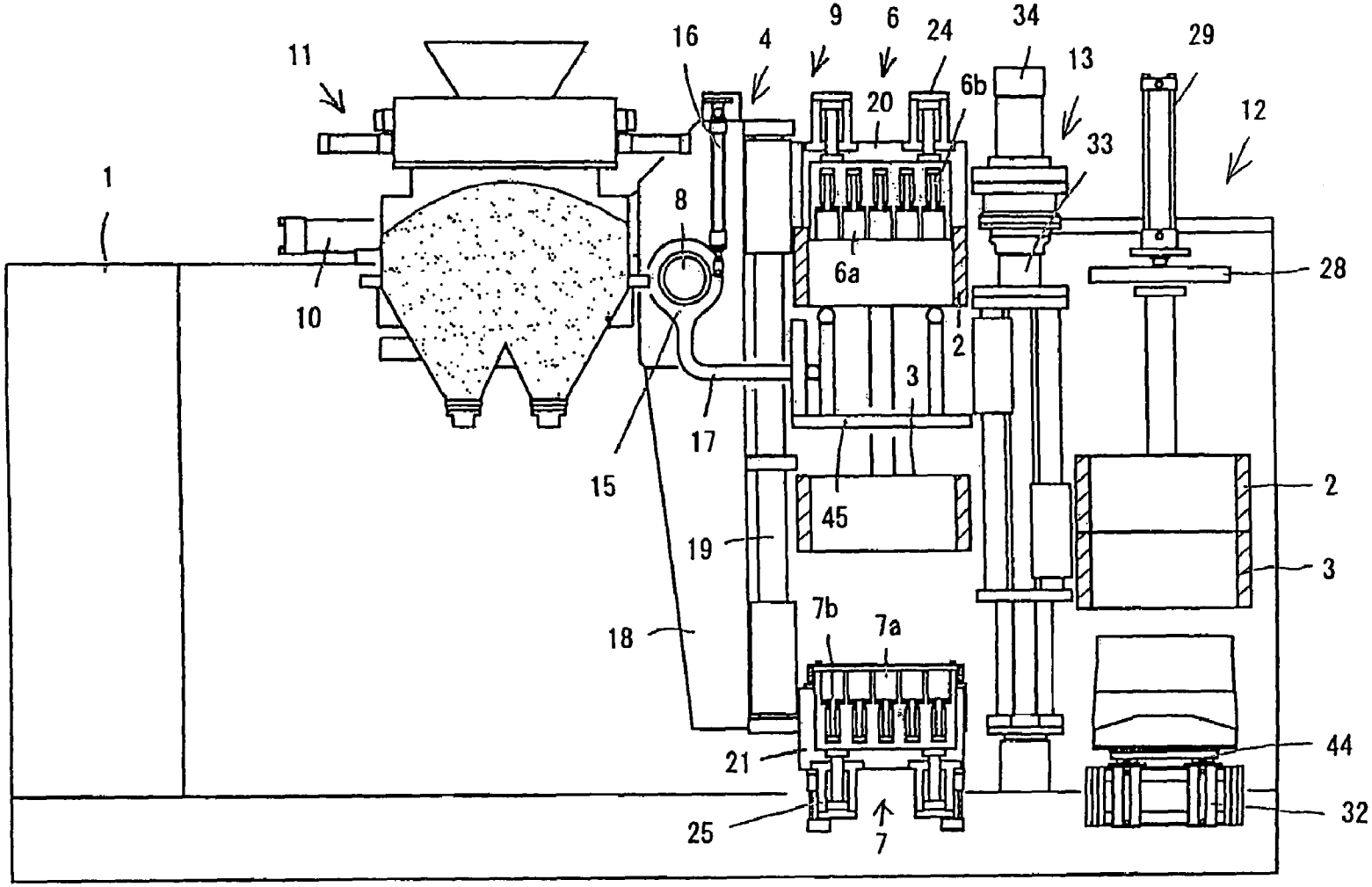
FIG. 2 shows a partially sectional view of FIG. 1.

As shown in FIG. 2, the conveying mechanism 4 for transferring the match plate 5 into and out of the position, comprises the following:

a ring member 15 disposed around the surface of the supporting shaft 8 of the squeezing mechanism 9, a cylinder 16 containing a piston rod and connected to a rotating frame 18, which is explained below, at its base end, and rotatably connected to a portion of the ring member 15 at the distal end of the piston rod of the cylinder 16, a pair of arms 17 fixed to the ring member 15 at its one end in a cantilevered structure, and a carrier plate 45 hung from rails so as to be able to hold the match plate 5 and reciprocate from side to side.

Figure 8:
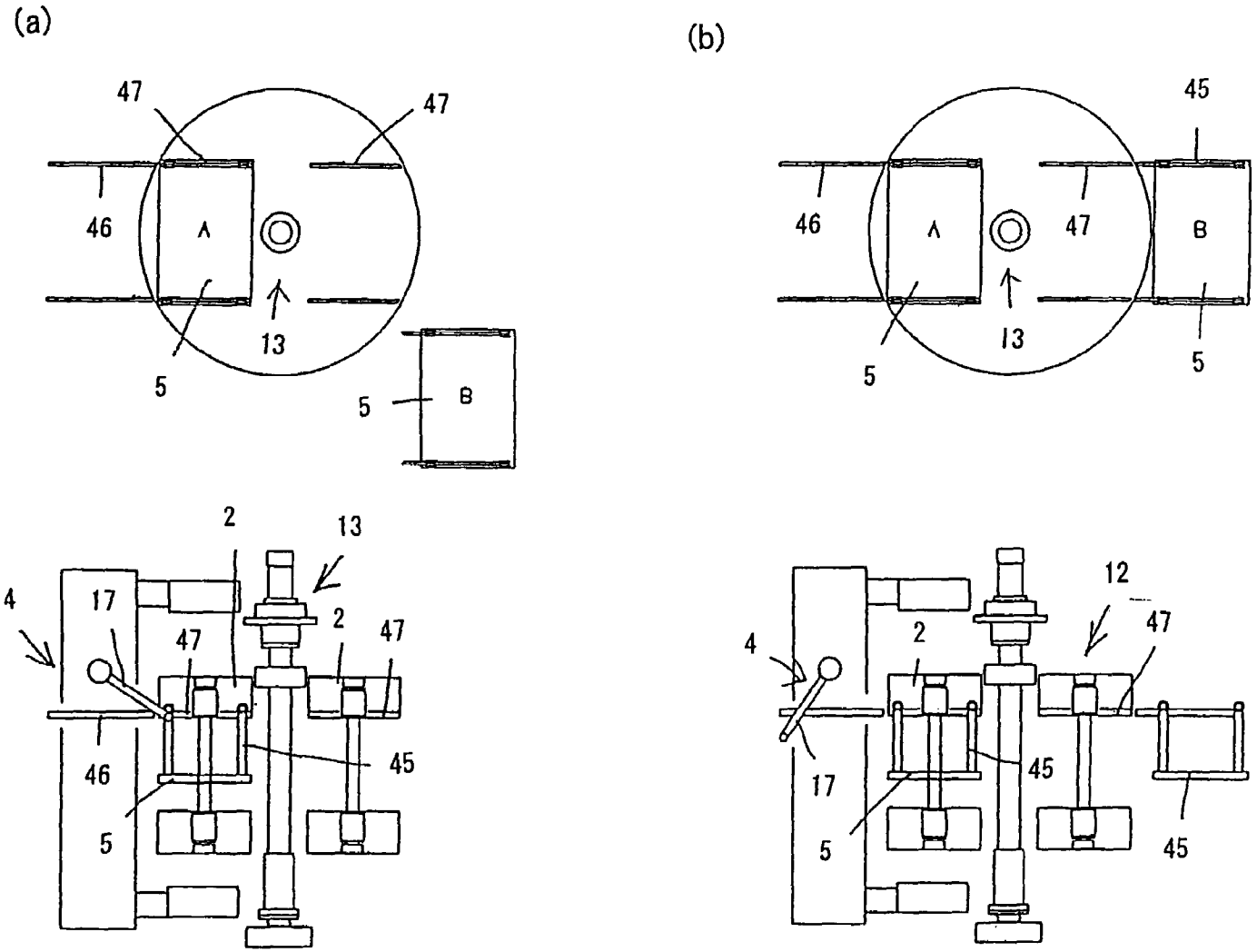
FIG. 8 shows an operational view explaining some of the processes for changing a match plate by using the apparatus shown in FIG. 1.

Since the pair of arms 17 can rotate upward or downward by the telescopic motion of the cylinder 16, the carrier plate 45 can insert the match plate 5 between the cope flask 2 and the drag flask 3 and take it out from therebetween, which flasks are located at the squeezing mechanism 9 and are horizontally positioned, through rails 46, 47, which are explained below (see FIGS. 8-10). Further, when the match plate is changed, by rotating the pair of the arms 17 upwardly and downwardly while the carrier plate 45 is slightly lowered by the downward movement of the cope flask 2, the arms 17 can be connected to or disconnected from the carrier plate 45.

As shown in FIGS. 1 and 2, the squeezing mechanism 9 is designed so that the mechanism 9 can hold the match plate 5 between the cope flask 2 and the drag flask 3 and so that the plurality of upper and lower segmented-squeeze feet 6*a*, 7*a* of the upper and the lower squeezing means 6, 7 can be insertable into each of the openings of the cope flask 2 and the drag flask 3, which openings are opposite to the match plate 5, respectively. In the squeezing mechanism 9, the rotating frame 18 is connected at a section near its center portion to the supporting shaft 8, which shaft 8 is disposed at the center of the upper portion of the base 1, so that the rotating frame 18 can be rotated clockwise or counterclockwise in a perpendicular plane about the supporting shaft 8. A pair of guide rods 19 extending vertically are disposed, with a predetermined interval therebetween, at the right side of the rotating frame 18 and at the front and rear sides of the apparatus (the right and the left side in FIG. 3). An upper lifting and lowering frame 20, having a reverse L-shaped configuration, is slidably disposed at upper portions of the guide rods 19 through holder portions fixed to the upper lifting and lowering frame 20. Also, a lower lifting and lowering frame 21, having an L-shaped configuration, is slidably disposed at lower portions of the guide rods 19 through holder portions fixed to the lower lifting and lowering frame 21. The upper and the lower lifting and lowering frames 20, 21 can move toward or away from each other by extending or contracting an upwardly-facing cylinder 22 and a downwardly-facing cylinder 23, which cylinders are disposed at the rotating frame 18. The rails 46 are disposed at the rotating frame 18 for guiding the carrier plate 45 when the pair of cope flasks 2 and drag flasks 3 are positioned horizontally. Further, the rails 47 are disposed at each of the cope flasks 2 for guiding the carrier plate 45 so that the height of the rails 47 corresponds to that of the rails 46 when the cope flasks 2 are lifted. (See FIGS. 8-10.)

As shown in FIG. 2, the upper and the lower squeezing means 6, 7 are disposed at the upper and the lower lifting and lowering frame 20, 21, respectively. The upper and the lower squeezing means 6, 7 have a plurality of cylinders 24, 25 driven by hydraulic pressure as a means for driving the segmented-squeeze feet, namely for moving the plurality of the upper and the lower segmented-squeeze feet 6*a*, 7*a* forward or backward.

These means for moving the segmented-squeeze feet can control the positions of the upper and the lower segmented-squeeze feet 6*a*, 7*a*, which positions determine the condition such as density of the molding sand in the molding space when the space is filled with the molding sand, according to the intervals between the match plate and each of the upper and the lower segmented-squeeze feet opposite to the match plate. The means for moving the segmented-squeeze feet is operated based on commands from a memory means (not shown) that stores the data on the configuration of the patterns on the match plate 5, while the cope flask and the drag flask are positioned from horizontal to perpendicular state. Each of the upper and the lower lifting and lowering frame 20, 21 has a proper and horizontal flat surface so as to be able to engage and push the cope flask 2 and the drag flask 3, respectively.

Where the wording of "the means for moving the segmented-squeeze feet is operated while the cope flask and the drag flask are positioned from horizontal to perpendicular state" is defined as the state that includes the following:

(1) it is operated when the cope flask and the drag flask are positioned horizontally, (2) it is operated when the cope flask and the drag flask are positioned perpendicularly, (3) it is operated while the cope flask and the drag flask are rotating from horizontal to perpendicular position, (4) it is operated starting from the position where the cope flask and the drag flask are positioned perpendicularly and while the cope flask and the drag flask rotate from the perpendicular to horizontal position, (5) it is operated starting from the position where the cope flask and the drag flask are positioned horizontally and while the cope flask and the drag flask rotate from the horizontal to perpendicular position, and (6) it is operated during the entire period of rotation from the position where the cope flask and the drag flask are positioned horizontally or perpendicularly to the position where the cope flask and the drag flask complete their rotation and take their perpendicular to horizontal position, respectively.

For an embodiment of this invention, a plurality of the cylinders driven by hydraulic pressure is used as the means for moving the segmented-squeeze feet. For this invention, however, other actuators, such as a plurality of cylinders driven by air pressure or electrically powered actuators, can be used. If the electrically powered actuators are used as the means for moving the segmented-squeeze feet, no big piping would be required and molding speed can be increased since it would be possible to define the molding space and to squeeze the molding sand while the squeezing mechanism 9 is rotating.

The sand-supplying mechanism 11 is disposed at the upper-left side portion of the base 1. The sand-supplying mechanism 11 has two means for fluidizing molding sand by the compressed air, which means are disposed at its lower portion and near sand-filling ports for supplying the molding sand. When the cope flask 2 and the drag flask 3 are filled with the molding sand, the molding sand is projected through the sand-filling ports by compressed air supplied above the molding sand while the compressed air injected the two sand fluidizing means is fluidizing the molding sand. The preferable pressure of the compressed air injected from the two means for fluidizing molding sand is 0.05 Mpa-0.18 Mpa. The two means for fluidizing molding sand can be driven simultaneously or based on the same control signal, instead of being driven independently.

In the stripping mechanism 12, a stripping plate 28, which is insertable into the cope flask 2 and the drag flask 3 that are stacked and positioned in the horizontal state, is connected to the lower end of the piston rod of a downwardly-facing cylinder 29 which is fixed to the top portion of the base 1. The stripping plate 28 can ascend and descend by the extending and contracting motion of the cylinder 29. Further, a receiving device 30 for supporting an upper and a lower mold that are stripped from the cope flask 2 and the drag flask 3 is disposed just below the stripping plate 28. The receiving member 30 is provided with an ascending and descending table 42 that can ascend and descend by a pantograph that is driven by the extending and contracting motion of the cylinder 31 and a table 44 for supporting molds, which table 44 can ascend and descend by the extending and contracting motion of the cylinder 43. The table 44 is disposed on the ascending and descending table 42. The use of the pantograph 32 allows the apparatus to dispense with a pit under the pantograph 32 (see FIGS. 3 and 4). Further, the pantograph 32 can be applied to the stripping mechanism 12 in order to downsize the molding apparatus.

In a swiveling mechanism 13 to swivel the flasks, a rotating shaft 33, which perpendicularly extends and can rotate around its axis, is disposed at the base 1. The upper end of the rotating shaft 33 is connected to an output shaft of a motor 34 disposed at the top portion of the base 1. The rotating shaft 33 can be rotated clockwise or counterclockwise for the range of 180 degree by driving the motor 34. A supporting member 35 is disposed at an upper portion of the rotating shaft 33. Two pairs of guide rods 36, which pair is comprised of two rods 36 that are disposed at the front and rear side of the rotating shaft 33 with a predetermined interval therebetween and extend downwardly, are fixed to the supporting member 35 so that the rods 36 are suspended from the supporting member 35. The two pairs of the guide rods 36 are opposed to each other and disposed at the right and the left side of the rotating shaft 33 so that the shaft 33 is located at the center of the pairs. Upper hooking members 37, which can hook the protuberances of the cope flasks 2, are mounted to each of the two pairs of the guide rods 36 and are sliderable upwardly and downwardly. The distal ends of the piston rods of upwardly-facing cylinders 38 that are disposed at the rotating shaft 33 are connected to the upper hooking members 37. The upper hooking members 37 can ascend and descend by extending and contracting the cylinders 38. Further, lower hooking members 39, which can hook the protuberances of the two drag flasks 3, are mounted to each lower end of the two pairs of the guide rods 36. Also, a number 40, shown in the figures, denotes an apparatus for pushing out the upper and the lower mold from the table 44, which molds are stripped from the cope flask 2 and the drag flask 3.

Below, a method for producing a flaskless upper mold and a flaskless lower mold is explained, starting from the state shown in FIG. 1, wherein the method uses the flaskless molding apparatus explained in the above paragraphs. First, a match plate 5 is inserted between a pair of horizontally positioned cope flask 2 and drag flask 3 by a pair of arms 17 by extending the cylinder 16 of a conveying mechanism 4.

Next, upper and lower lifting and lowering frames 20, 21 are made to move toward each other by contracting the upwardly-facing cylinders 22 and the downwardly-facing cylinder 23 of the squeezing mechanism 9. Simultaneously, the cope flask 2 and the drag flask 3 are made to move toward each other by lowering the upper hooking members 37 caused by the contraction of the cylinder 38. Then, while a match plate 5 is being held between the cope flask 2 and the drag flask 3, a plurality of the upper and the lower segmented-squeeze feet 6*a*, 7*a* of an upper and a lower squeezing means 6, 7 are inserted into the cope flask 2 and the drag flask 3 respectively to define the upper and the lower molding space by extending the plurality of cylinders 24, 25 of the squeezing mechanism 9 for a predetermined length. Simultaneously, the pair of cope flask 2 and drag flask 3 and the match plate 5 are rotated so as to become perpendicular by rotating the squeezing mechanism 9 clockwise about the supporting shaft 8 by extending the cylinder 10. Also, the sand-filling ports of the cope flask 2 and the drag flask 3 are moved upwardly and are communicated with the lower ends of the sand-supplying mechanism 11 respectively (see FIG. 5 (*a*)). During the clockwise rotation of the squeezing mechanism 9, the plurality of upper and lower segmented-squeeze feet 6*a*, 7*a* of the upper and the lower squeezing means 6, 7 are inserted into the cope flask 2 and the drag flask 3 for a predetermined length respectively by extending the plurality of cylinders 24, 25 of the squeezing mechanism 9.

Figure 5:
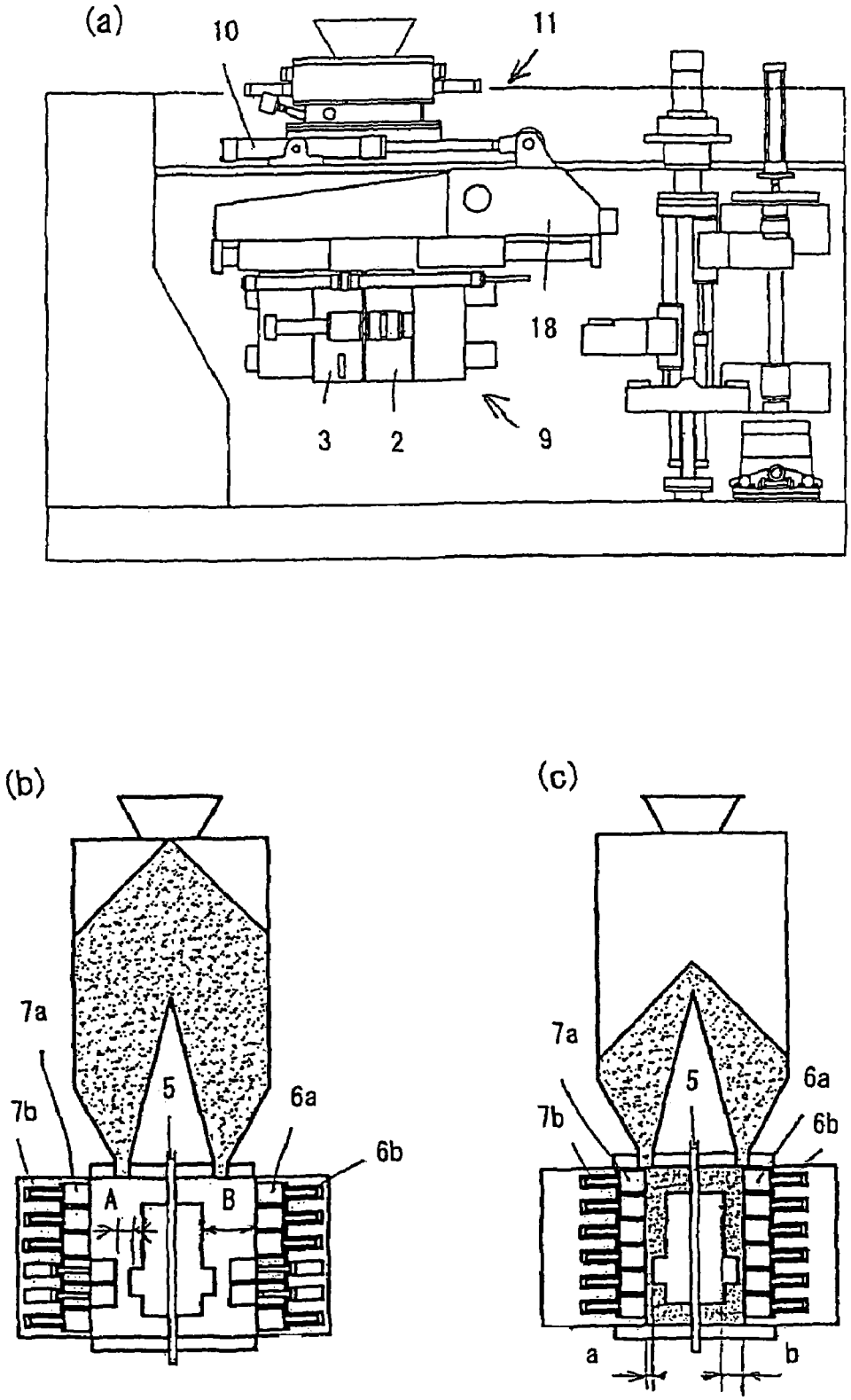
FIG. 5 shows an operational view explaining some of the processes for molding a mold by the flaskless molding apparatus for an upper and a lower mold shown in FIG. 1.

Next, the intervals between the surfaces of the patterns of the match plate 5 and the plurality of upper and lower segmented-squeeze feet 6*a*, 7*a* opposed to the match plate 5 are adjusted by extending the plurality of cylinders 6*b*, 7*b* of the upper and lower squeezing means 6, 7 for a predetermined length so that the ratio of the intervals before squeezing to the ratio after squeezing become almost equal. Namely, when the intervals between the surfaces of the patterns of the match plate 5 and the plurality of upper and lower segmented-squeeze feet 6*a*, 7*a* opposed to the match plate 5 before squeezing molding sand are defined as "A" and "B" respectively as shown in FIG. 5(*b*), and those after squeezing molding sand are defined as "a" and "b" respectively as shown in FIG. 5(*c*), the intervals are adjusted so that the ratios of "a/A" and "b/B" become near the relationship of "a/A=b/B." In other words, at the part where the surface of the pattern is higher than other parts, the upper and the lower segmented-squeeze feet 6*a*, 7*a* are extended so that the quantity of the molding sand to be compressed decreases. In contrast, at the part where the surface of the pattern is lower than other parts, the upper and the lower segmented-squeeze feet 6*a*, 7*a* are kept still so that the quantity of the molding sand to be compressed increases.

Then, the upper and the lower molding spaces are filled with the molding sand by the sand-supplying mechanism 11 through the sand-filling ports of the cope flask 2 and the drag flask 3. Next, while the pair of the cope flask 2, the drag flask 3 and the match plate 5 are being rotated from the perpendicular state to the horizontal state, the molding sand in the upper and the lower molding space is squeezed by moving the plurality of upper and lower segmented-squeeze feet 6*a*, 7*a* further forwardly by extending the plurality of cylinders 24, 25. Then, after the plurality of upper and lower segmented-squeeze feet 6*a*, 7*a* that are projected forwardly are moved backwardly by contracting the plurality of cylinders 6*b*, 7*b*, the plurality of upper and lower segmented-squeeze feet 6*a*, 7*a* are moved forwardly by further extending the plurality of cylinders 24, 25. As a result of these processes, the density of the molding sand of the molded upper and lower molds becomes substantially uniform. Also, the surfaces of the upper and the lower molds that face the upper and the lower segmented-squeeze feet 6*a*, 7*a* of an upper and a lower squeezing means become substantially flat. (See FIG. 5(*c*).)

Next, the upper and the lower lifting and lowering frame 20, 21 are moved apart from each other by extending the upwardly-facing cylinder 22 and the downwardly-facing cylinder 23. Then, the cope flask 2, which contains the mold formed by squeezing the molding sand, is lifted via the upper hooking members 37 by extending the cylinder 38 of the swiveling mechanism 13 and is separated from the match plate 5. The drag flask 3 is placed on the lower hooking members 39 of the swiveling mechanism 13. Next, the match plate 5 is transferred from between the cope flask 2 and the drag flask 3 by the pair of arms 17 put in action by contracting the cylinder 16. Then, the cope flask 2 and the drag flask 3, which contain the molded molds, are swiveled and moved to the position of the stripping mechanism 12 by rotating the rotating shaft 33 for a predetermined angle by driving the motor 34 of the swiveling mechanism 13. Next, after setting a core in the mold if it is necessary, the cope flask, which contains the molded mold, is lowered via the upper hooking members 37 lowered by contracting the cylinders 38 and is stacked on the drag flask 3.

Next, by lifting the table 44 for supporting molds by extending the cylinder 43 of the receiving member 30, and by further lifting it through the ascending and descending table 42 by extending the cylinder 31, the cope flask 2 and the drag flask 3, which contain the molded molds, are placed on the table 44. Then, after the stripping plate 28 is abutted on the upper surface of the mold in the cope flask 2 by extending the cylinder 29, the upper and the lower mold are stripped from the cope flask 2 and the drag flask 3 by simultaneously lowering the stripping plate 28 and the table 44 by extending and contracting the cylinders 29 and 43 respectively. Next, the upper and the lower mold are further lowered through the ascending and descending table 42 and the table 44 by contracting the cylinder 31. Then, the apparatus 40 for pushing out molds pushes out the upper and the lower molds on the table 44.

In the process explained above, before the cope flask 2 and the drag flask 3, which contain the molded molds, are swiveled and moved to the position of the stripping mechanism 12, the core may be set in the molds that have been already molded if it is necessary, and then, in the same way as explained above, the pair of the cope flask 2 and the drag flask 3 are stacked, and then the molds are stripped from these flasks.

For the preferred embodiment explained above, when the intervals between the surfaces of the patterns of the match plate 5 and the plurality of upper and lower segmented-squeeze feet 6*a*, 7*a* of an upper and a lower squeezing means 6, 7 opposed to the match plate 5 before squeezing molding sand are defined as "A" and "B" respectively, and those after squeezing molding sand are defined as "a" and "b" respectively, the locations of the upper and the lower segmented-squeeze feet 6*a*, 7*a* are adjusted so that the ratios of "a/A" and "b/B" become close to the relationship of "a/A=b/B." However, this invention is not limited to this method. In this invention, the any method that can produce the molds having a substantially uniform density of the molding sand after squeezing it, can be used based on the concept that the positions of a plurality of upper and lower segmented-squeeze feet, which determine the state of the molding sand filled in the molding spaces, are controlled according to the intervals between the surfaces of patterns of a match plate and the surfaces of a plurality of upper and lower segmented-squeeze feet opposed to the match plate.

Figure 7:
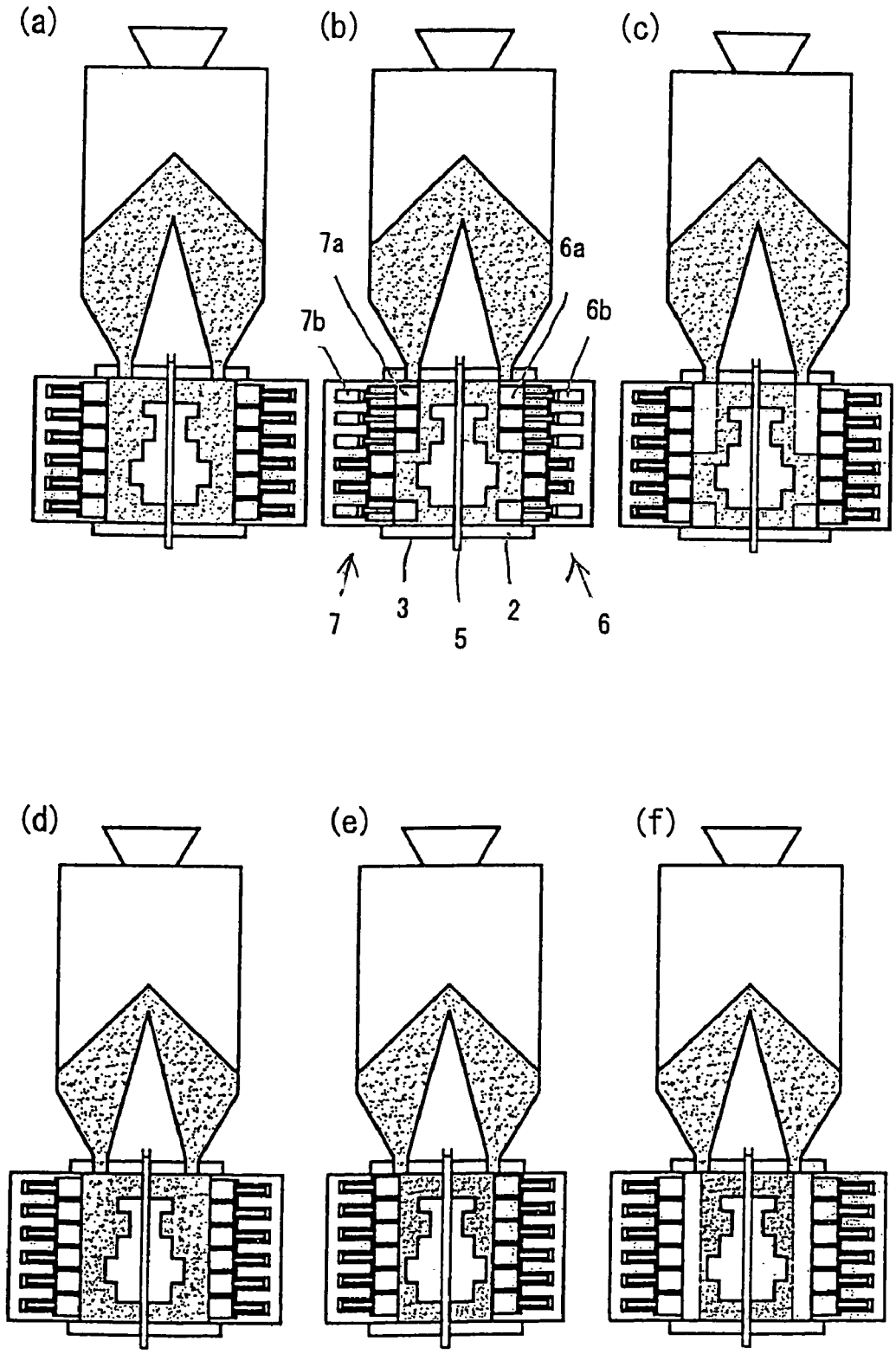
FIG. 7 shows an operational view explaining some of the processes for molding a mold by the flaskless molding apparatus for an upper and a lower mold shown in FIG. 1.

For example, as shown in FIG. 7(*a*)-7(*f*), after an upper and a lower molding space are defined by a match plate 5, a cope flask 2 and a drag flask 3, and an upper and a lower segmented-squeeze feet 6*a*, 7*a* of an upper and a lower squeezing means 6, 7 at the perpendicular position, the molding spaces are filled with molding sand through the sand-filling ports of the cope flask 2 and the drag flask 3. Then, the molding sand in the upper and the lower molding spaces is squeezed by forwardly moving the plurality of upper and lower segmented-squeeze feet 6*a*, 7*a* driven by extending each of the plurality of cylinders 6*b*, 7*b*. Next, once the plurality of upper and lower segmented-squeeze feet 6*a*, 7*a* are moved backwardly by contracting the plurality of cylinders 6*b*, 7*b*. Then, the upper and the lower molding spaces are further filled with molding sand through the sand-filling ports. After the squeezing surfaces of the plurality of upper and lower segmented-squeeze feet 6*a*, 7*a* are uniformly positioned on a plane, the molding sand in the upper and lower molding spaces may be further squeezed by moving forwardly in unison the plurality of upper and lower segmented-squeeze feet 6*a*, 7*a*, driven by extending the plurality of cylinders 24,25.

Here, for the plurality of upper and lower segmented-squeeze feet 6*a*, 7*a*, it is possible to make two or more of the upper and the lower segmented-squeeze feet integrated.

Figure 6:
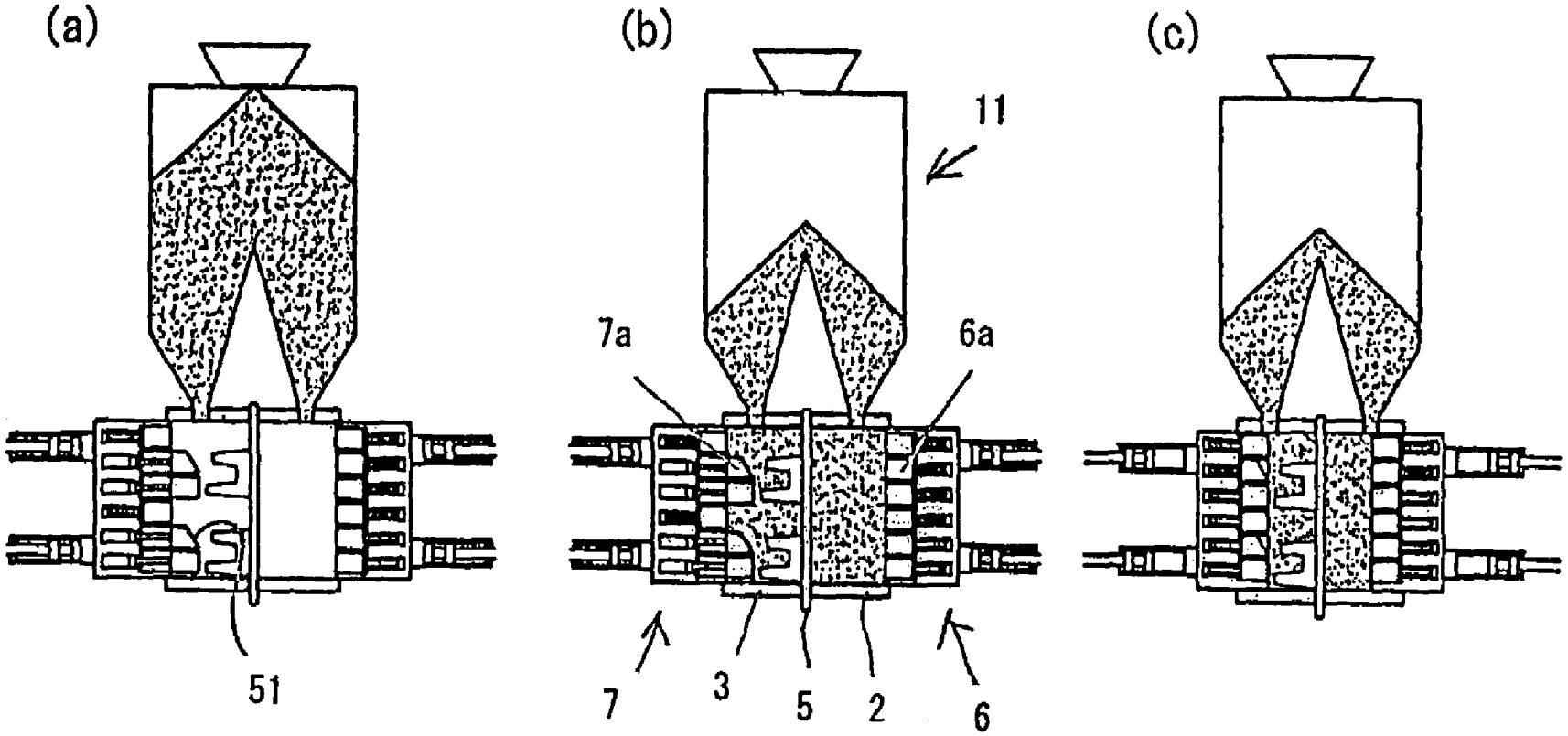
FIG. 6 shows an operational view explaining some of the processes for molding a mold by the flaskless molding apparatus for an upper and a lower mold shown in FIG. 1.

As shown in FIGS. 6(*a*)-6(*c*), for the purpose of improving flowability of molding sand between the pattern of the match plate 5 and the plurality of upper and lower segmented-squeeze feet 6*a*, 7*a* of the upper and the lower squeezing means 6, 7 opposed to the match plate 5, slanted surfaces 51 are formed on the part of the plurality of lower segmented-squeeze feet. Here, although the slanted surfaces 51 are formed only on the lower segmented-squeeze feet, they may be formed on the part of the plurality of upper segmented-squeeze feet or on the part of each of the plurality of upper and lower segmented-squeeze feet.

Further, the molding apparatus of this invention may have an air relief mechanism on the match plate 5 so that a portion of the bottom of the molding space, behind the corners of the pattern of the match plate 5 can be completely filled with the molding sand.

Next, for the flaskless molding apparatus for molds explained in the above paragraphs, a procedure for changing a match plate 5 is explained below. First, as shown in FIG. 8(*a*), cope flasks 2, 2 are hooked by lifting upper hooking members 37, 37, which are lifted by extending cylinders 38, 38 of a swiveling mechanism 13. Then, a carrier plate 45 having the match plate 5 (A) is transferred from rails 46 to rails 47 of the cope flask 2 by rotating a pair of arms 17 counterclockwise which rotation is caused by extending a cylinder 16 of a conveying mechanism 4. Then the match plate 5(A) is placed below the left cope flask 2. Next, as shown in FIG. 8(*b*), while the cope flask 2 is slightly being lifted and lowered by extending and contracting the cylinders 38, the pair of the arms 17 is disconnected from the carrier plate 45 by rotating the pair of the arms 17 clockwise, which rotation is caused by contracting the cylinder 16 of the conveying mechanism 4. Then, the pair of arms 17 are returned to the initial position. The carrier plate 45 having a match plate 5 (B) to be substituted is suspended from rails disposed on a suitable transferring device and is ready and waiting at the side of the stripping mechanism 12. The carrier plate is moved to the position opposed to the rails 47 of the right cope flask 2 placed at the stripping mechanism 12.

Figure 9:
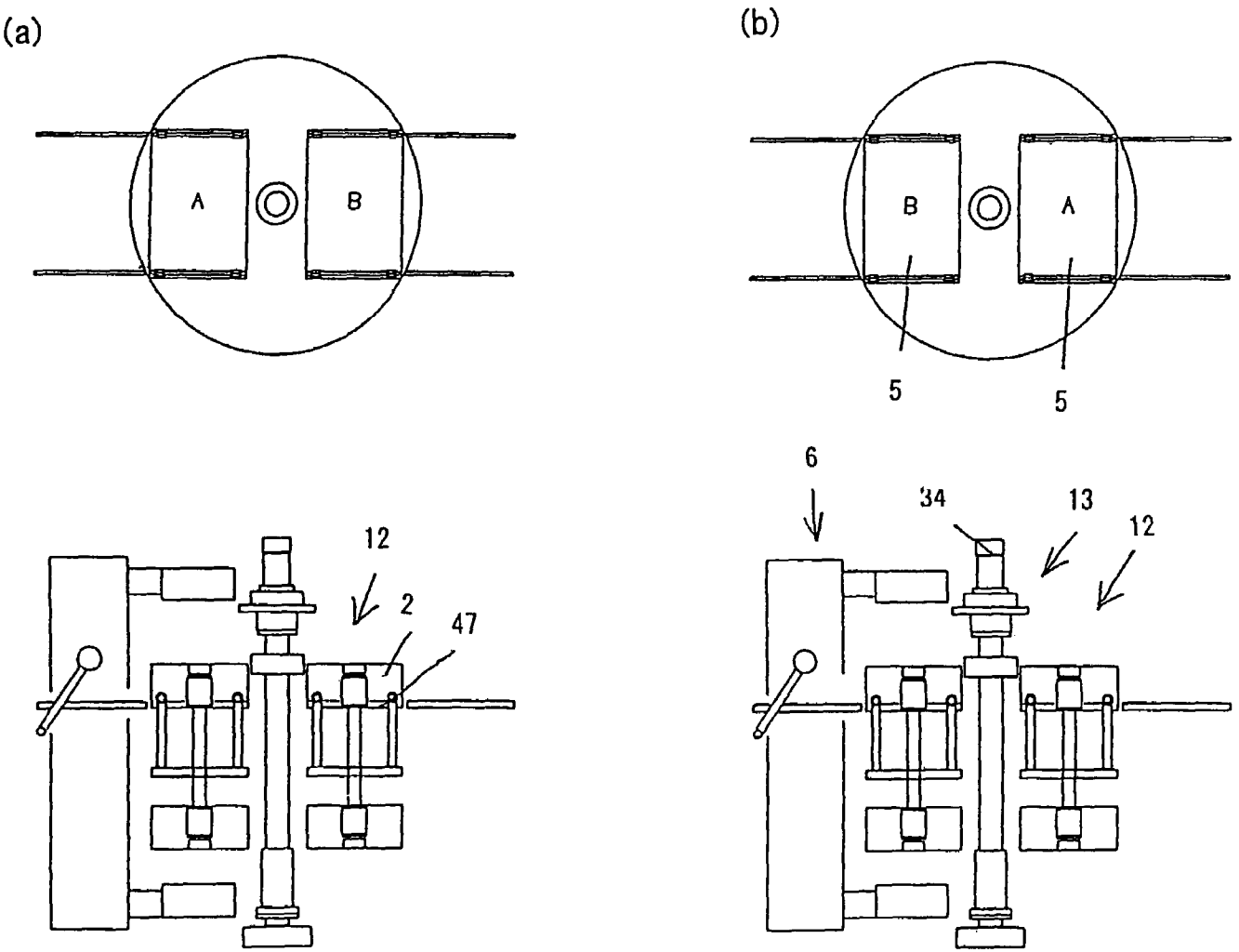
FIG. 9 shows an operational view explaining some of the processes for changing a match plate by using the apparatus shown in FIG. 1.

Next, as shown in FIG. 9(*a*), the carrier plate 45, which is placed at the position opposed to the rails 47 of the right cope flask 2 placed at the stripping mechanism 12, is manually transferred onto the rails 47 of the right cope flask 2. As a result of this operation, the right match plate 5(B) is placed below the right cope flask 2. Then, as shown FIG. 9(*b*), the swiveling mechanism 13 is rotated by driving a motor 34, and the left match plate 5(A) placed at the squeezing mechanism 9 is moved to the stripping mechanism 12, and the right match plate 5(B) placed at the stripping mechanism 12 is moved to the squeezing mechanism 9.

Figure 10:
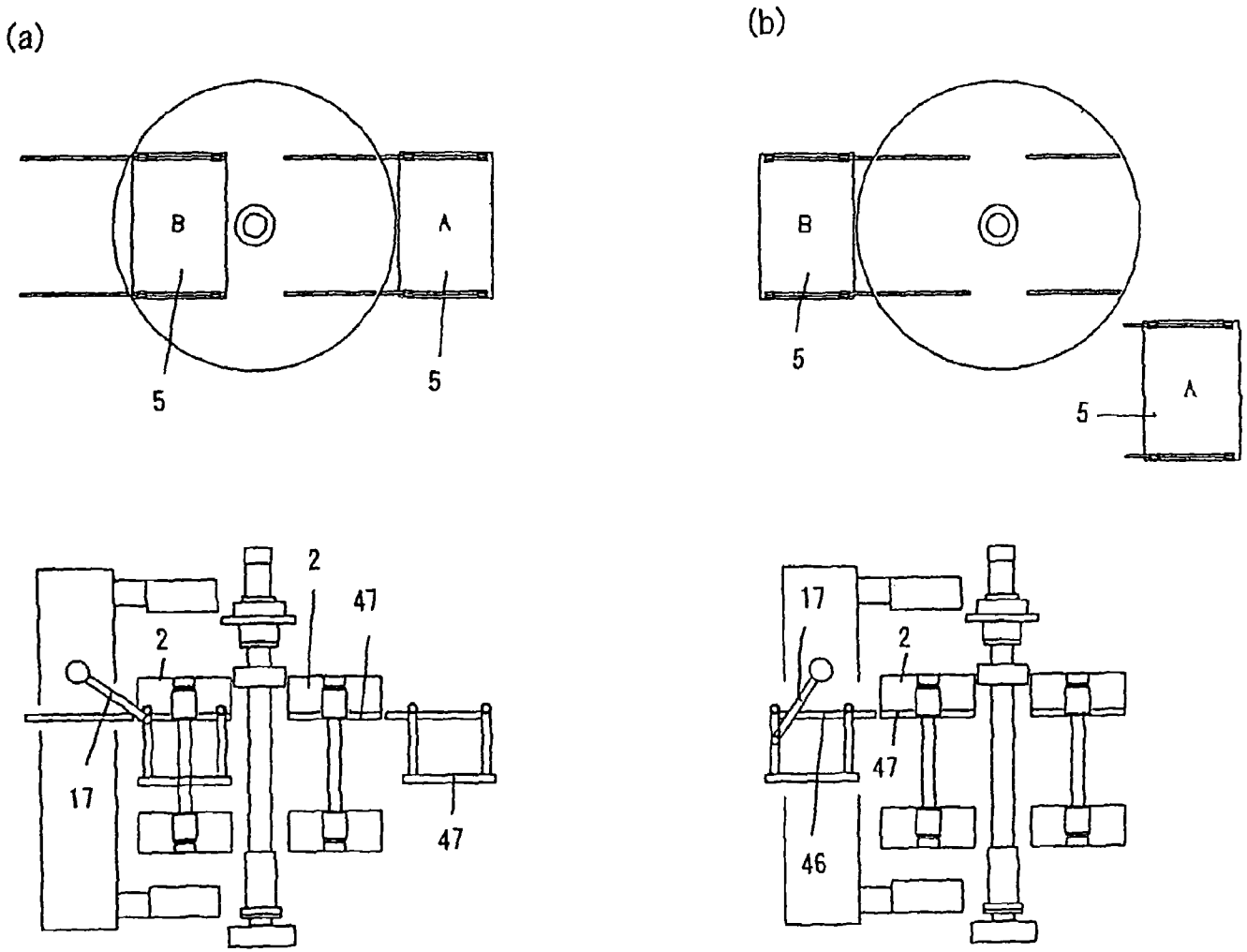
FIG. 10 shows an operational view explaining some of the processes for changing a match plate by using the apparatus shown in FIG. 1.

Next, as shown in FIG. 10(*a*), while the left cope flask 2 is slightly being lifted and lowered by extending and contracting the cylinders 38, the pair of arms 17 is connected to the carrier plate 45 having the match plate 5(B) by rotating the pair of the arms 17 counterclockwise, which rotation is caused by extending the cylinder 16 of the conveying mechanism 4. Simultaneously, the carrier plate 45 having the match plate 5(A) is moved from the rails 47 of the right cope flask 2 onto the rails of the suitable transferring device. Next, as shown in FIG. 10(*b*), the carrier plate 45 having the match plate 5(B) is moved from the rails 47 of the left cope flask 2 onto the rails 46 by rotating the pair of the arms 17 clockwise, which rotation is caused by contracting the cylinder 16 of the conveying mechanism 4. As the result of this operation, the match plate 5(B) is transferred from the cope flask 2. Further, the carrier plate 45 having the match plate 5(A), placed at the suitable transferring device, are moved to a suitable place by moving a suitable transferring device. By these operations explained above, the procedure for changing a match plate is completed.

For this embodiment, to handle two pairs of cope flask and drag flask, the apparatus is comprised of:

a stripping mechanism to strip an upper and a lower mold from the pair of cope flask and drag flask, which have already been subjected to squeezing operation, are stacked, horizontally positioned, and contain the upper and the lower mold, and a swiveling mechanism to alternately and intermittently swivel the two pairs of cope flasks and drag flasks, which are stacked perpendicularly, aligned horizontally, and are maintained horizontally, between the place of the stripping mechanism and that of the squeezing mechanism, which holds an other pair of cope flask and drag flask maintained horizontally, wherein the swiveling mechanism can also lift and lower the cope flasks.

However, this invention is not restricted to this constitution. A molding apparatus that has a constitution that has no swiveling mechanism and that handles just a pair of cope flask and drag flask can be used.

What we claim is:

1. A flaskless molding apparatus for an upper and a lower mold formed of molding sand that are stacked, comprising:

(a) two pairs of a cope flask and a drag flask, wherein each flask has openings at both ends of each flask and has a sand-filing port at a side wall thereof, (b) a conveying mechanism for inserting a match plate having patterns between one pair of the cope flask and the drag flask and for taking the match plate out from therebetween, (c) a squeezing mechanism to squeeze molding sand, comprising upper squeezing means having a plurality of upper segmented-squeeze feet and upper cylinders for moving the upper segmented-squeeze feet and lower squeezing means having a plurality of lower segmented-squeeze feet and lower cylinders for moving the lower segmented-squeeze feet, wherein the plurality of upper and lower segmented-squeeze feet are insertable into an opening at one end of each of the cope flask and the drag flask of the one pair respectively, which openings are at an opposite end from the match plate, (d) a supporting shaft, a rotating frame rotatable in a perpendicular plane about said shaft, said squeezing mechanism being mounted on said rotating frame for movement therewith, and a driving mechanism to rotate the rotating frame and the mounted squeezing mechanism clockwise or counterclockwise about said shaft in said perpendicular plane, wherein the squeezing mechanism supports the one pair of the cope flask and the drag flask with the match plate held therebetween for rotation with the rotating frame clockwise or counterclockwise in the perpendicular plane about the supporting shaft and so that the cope flask and the drag flask of the one pair can be positioned horizontally or vertically thereto, (e) a sand-supplying mechanism to fill molding spaces defined by the match plate and the plurality of upper and lower segmented-squeeze feet opposite to the match plate with molding sand, through the sand-filling ports of the cope flask and the drag flask of the one pair when vertically positioned by the driving mechanism, (f) means for controlling the cylinders for moving the segmented-squeeze feet so that positions of the upper and the lower segmented-squeeze feet, which positions determine the condition of the molding sand in the molding space when the space is filled with the molding sand, are controlled according to intervals between the match plate and each of the upper and the lower segmented-squeeze feet opposite to the match plate and so that after squeezing the molding sand, upper and lower molds are formed in the one pair of the cope flask and the drag flask comprised of molding sand with a substantially uniform density, wherein the means for controlling the cylinders for moving the segmented-squeeze feet moves the upper and lower segmented-squeeze feet in the one pair of the cope flask and the drag flask while said one pair is being moved from a horizontal to a vertical position and from a vertical to a horizontal position, (g) a stripping mechanism to strip the upper and lower molds from the one pair of the cope flask and the drag flask that have been squeezed, which molds are stacked and are horizontally positioned, and (h) a swiveling mechanism to swivel the two pairs of the flasks, comprising a rotating shaft disposed at a base, the shaft having two pairs of guide rods suspended from a supporting member, which member is disposed at an upper portion of the rotating shaft, wherein the two pairs of guide rods hook the cope flasks so that the cope flasks are slideable upwardly and downwardly, and can hook the drag flasks at the lower end of the guide rods, and wherein the swiveling mechanism alternately and intermittently swivels the two pairs of cope flasks and drag flasks, one pair being disposed at the squeezing mechanism and maintained horizontally and the other pair being disposed at the stripping mechanism and maintained horizontally, between the stripping mechanism and the swiveling mechanism by rotating the rotating shaft, and can lift and lower the cope flasks.

2. The apparatus of claim 1, wherein the means for controlling the cylinders for moving the segmented-squeeze feet controls the position of the upper and the lower segmented-squeeze feet so that ratios of the intervals between surfaces of the upper and the lower segmented squeeze feet and surfaces of the patterns of the match plate before squeezing the molding sand to those after squeezing the molding sand become substantially equal respectively.

3. The apparatus of claim 1, wherein the molding sand is squeezed by moving forward the plurality of upper and lower segmented-squeeze feet after the molding spaces are filled with the molding sand, wherein the plurality of upper and lower segmented-squeeze feet is moved backwardly, and thereafter the molding spaces created by said backward movement are filled with additional molding sand, and wherein each squeezing surface of the plurality of upper and lower segmented-squeeze feet is controlled so that the surfaces form a plane.

4. The apparatus of any one of claims 1-3, further comprising a slanted surface formed at a squeezing surface of a part of the plurality of upper and/or lower segmented-squeeze feet to improve flowability of the molding sand in the molding spaces.

5. The apparatus of any one of claims 1-3, wherein the means for controlling the cylinders for moving the segmented-squeeze feet is operated based on commands from a memory means that stores data on the configuration of the patterns of the match plate.

6. The apparatus of any one of claims 1-3, further including an air relief mechanism disposed at the match plate so as to completely fill a cornered bottom portion of the molding space formed by the patterns of the match plate with the molding sand.

* * * * *